US005749166A

United States Patent [19]

Brooks

[11] Patent Number: 5,749,166

[45] Date of Patent: May 12, 1998

[54] GUN LOCK ASSEMBLY

[75] Inventor: Frank Brooks, Jupiter, Fla.

[73] Assignee: SAF T LOK Corporation, Tequesta, Fla.

[21] Appl. No.: 489,070

[22] Filed: Jun. 8, 1995

Related U.S. Application Data

[63] Continuation-in-part of Ser. No. 929,201, Aug. 13, 1992, Pat. No. 5,457,907, which is a continuation-in-part of Ser. No. 645,565, Jan. 24, 1991, Pat. No. 5,140,766, and Ser. No. 645,566, Jan. 24, 1991, Pat. No. 5,229,532, said Ser. No. 645,565, and Ser. No. 645,566, each is a continuation-in-part of Ser. No.556,016, Jul. 20, 1990, Pat. No. 5,090,148, and Ser. No. 202,988, Jun. 6, 1988, Pat. No. 4,987,693.

[51] Int. Cl.[6] ..... F41A 17/00

[52] U.S. Cl. ..... 42/70.11; 42/70.06; 42/66

[58] Field of Search ..... 42/70.11, 70.06, 42/66, 65, 41; 124/58, 31, 40

[56] References Cited

U.S. PATENT DOCUMENTS

| | | | |
|---|---|---|---|
| H278 | 6/1987 | Steiner | 42/77 |
| 804,694 | 11/1905 | Whiting | 89/138 |
| 849,825 | 4/1907 | Allen | 42/66 |
| 1,480,759 | 1/1924 | Hill | 70/306 |
| 1,484,671 | 2/1924 | Pomeroy | 89/137 |
| 2,803,910 | 8/1957 | Lyle | 42/70 |
| 2,846,925 | 8/1958 | Norman | 89/145 |
| 2,994,981 | 8/1961 | Carrigan | 42/66 |
| 3,115,765 | 12/1963 | Fengler | 70/315 |
| 3,159,080 | 12/1964 | Freed | 89/148 |
| 3,199,240 | 8/1965 | Largen | 42/70 |
| 3,368,927 | 2/1968 | Worsham | 136/160 |
| 3,729,014 | 4/1973 | Narumi | 137/101 |
| 3,735,519 | 5/1973 | Fox | 42/70 D |
| 3,757,634 | 9/1973 | Uria et al. | 89/105 |
| 3,768,189 | 10/1973 | Goodrich | 42/1 N |
| 3,879,877 | 4/1975 | Cizeron | 42/42 R |
| 3,939,679 | 2/1976 | Barker et al. | 70/277 |
| 4,003,152 | 1/1977 | Barker et al. | 42/70 R |
| 4,014,123 | 3/1977 | Williams | 42/1 LP |
| 4,084,341 | 4/1978 | Cervantes | 42/1 Y |
| 4,091,556 | 5/1978 | Katsenes | 42/42 R |
| 4,091,557 | 5/1978 | Murabito | 42/66 |
| 4,291,481 | 9/1981 | Hillberg | 40/70 A |
| 4,302,898 | 12/1981 | LaRue | 42/1 LP |
| 4,306,487 | 12/1981 | Beretta | 89/189 |
| 4,457,091 | 7/1984 | Wallerstein | 42/1 LP |
| 4,488,370 | 12/1984 | Lemelson | 42/70 R |

(List continued on next page.)

OTHER PUBLICATIONS

Shooting Times, Apr. 1973, "Is Your Safety Really Safe?" pp. 40–43 and 78.

Beretta dal 1526, Series 81, Instructions for operation, Sep. 1986.

Smith & Wesson, Revolvers, Safety and Instruction Manual, Apr. 1987.

Smith & Wesson, Semiautomatic Centerfire Pistols, Safety, Instruction and Parts Manual, Jun. 1988.

*Primary Examiner*—Michael J. Carone
*Assistant Examiner*—Meena Chelliah
*Attorney, Agent, or Firm*—Quarles & Brady

[57] ABSTRACT

A gun lock assembly includes an engagement portion with a locked position in which a portion of the firing mechanism is operatively engaged to prevent firing of the firearm, and an unlocked position in which operation of the firearm is permitted. The lock preferably includes a lock housing with structure for attaching the lock housing to the firearm. An adaptor can be utilized to facilitate attachment of the lock to a variety of different guns. A preferred combination lock is disclosed with structure for altering the combination. An embodiment that is suitable for long arms is also disclosed. An adaptor plate can be provided with an lever which is moveable with operation of the lock to selectively engage a portion of the firearm to selectively permit or prevent operation of the firearm. Embodiments are disclosed where the lever is utilized to engage the drawbar of a firearm, the rebound slide of a firearm, or the hammer stirrup of the firearm.

6 Claims, 16 Drawing Sheets

U.S. PATENT DOCUMENTS

| | | | |
|---|---|---|---|
| 4,499,681 | 2/1985 | Bako et al. | 42/1 Y |
| 4,641,449 | 2/1987 | Kapland et al. | 42/65 |
| 4,682,435 | 7/1987 | Heltzel | 42/70.01 |
| 4,763,431 | 8/1988 | Allan et al. | 42/70.11 |
| 4,787,224 | 11/1988 | Mesa | 70/313 |
| 4,791,747 | 12/1988 | Pastor | 42/66 |
| 4,827,649 | 5/1989 | Sheehan | 42/70.11 |
| 4,845,870 | 7/1989 | Vernon | 42/70.08 |
| 5,086,579 | 2/1992 | Flatley et al. | 42/70.08 |
| 5,088,222 | 2/1992 | Larson | 42/70.04 |
| 5,225,612 | 7/1993 | Bernkrant | 42/70.02 |
| 5,335,521 | 8/1994 | Brooks | 70/298 |

GUN LOCK ASSEMBLY

CROSS-REFERENCE TO RELATED APPLICATIONS

This application is a continuation-in-part of Applicant's application Ser. No. 929,201, filed Aug. 13, 1992, now U.S. Pat. No. 5,457,907, which is a continuation-in-part application of Applicant's U.S. patent application Ser. No. 645,565, filed Jan. 24, 1991, now U.S. Pat. No. 5,140,766, and U.S. patent application Ser. No. 645,566, filed Jan. 24, 1991, now U.S. Pat. No. 5,229,532, which are continuations-in-part of Applicant's U.S. patent application Ser. No. 556,016, filed Jul. 20, 1990, now U.S. Pat. No. 5,090,148, and Applicant's U.S. patent application Ser. No. 202,988, filed Jun. 6, 1988, now U.S. Pat. No. 4,987,693.

BACKGROUND OF THE INVENTION

1. Field of the Invention

This invention relates generally to firearm locks, and more particularly to firearm locks which are provided so as to be substantially integral with the firearm.

2. Description of the Relevant Art

There is a continuing need to provide locks for firearms which will effectively prevent operation of the firearm by unauthorized users, but which are readily manipulated by authorized users to permit deactivation of the lock and operation of the firearm in an emergency. It is desirable that such a lock be easily installed and non-intrusive to the integrity of the firearm, such that continued reliability of the firearm is insured after installation of the lock. It is also desirable that such a lock be entirely integral with the firearm, such that the lock or a key for the lock cannot be misplaced or lost.

There have been many attempts to devise locks for firearms which will prevent unauthorized use of the firearm. These locks often are not integral with the firearm, and accordingly, must be removed in order to render the firearm operable, and can thereby be lost or misplaced. Prior locks for firearms which have been made to be integral with the firearm require extensive modification to the firearm, and thus can affect the reliability of the firearm and require time and expense for proper installation. These firearm locks are sometimes difficult to manipulate, and therefore can be dangerous in an emergency where quick operation of the firearm is necessary.

There are many types of firearms, with different handle sizes and configurations and firing mechanism designs. It would be desirable to provide a lock construction which is readily adaptable for use with many different types of guns.

SUMMARY OF THE INVENTION

It is an object of the invention to prevent the operation of firearms by unauthorized users.

It is another object to the invention to provide a lock for firearms which is easily installed.

It is yet another object of the invention to provide a lock for firearms which is integral with the firearm and will preclude the possibility that the lock will be lost or misplaced.

It is another object of the invention to provide a lock for firearms which will not affect the reliability of the firearm.

It is still another object of the invention to provide a lock for firearms which can be readily deactivated to permit quick operation of the firearm in an emergency.

It is yet another object of the invention to provide a lock for firearms which can be installed in the firearm without extensive modification to the firearm.

It is still another object of the invention to provide a lock assembly in which the combination required to open the lock can be readily changed by an authorized user.

It is another object of the invention to provide a lock assembly which can be adapted for different models and designs of hand guns or long arms.

These and other objects are accomplished by a gun lock assembly having an engagement portion with a locked position in which a portion of the firing mechanism is operatively engaged to prevent firing of the firearm, and an unlocked position in which operation of the firearm is permitted. Several portions of the firing mechanism are currently preferred, including the hammer, hammer stirrup, leaf spring and rebound slide. The lock preferably comprises a lock housing with structure for attaching the lock housing to the firearm.

An adaptor is preferably provided which can be attached to the frame of the firearm. This can be accomplished in pre-existing firearms by removing the existing handle grip of the firearm and attaching an adaptor to the firearm with fastening structure. The adaptor is preferably a plate with engagement structure for engaging a portion of the lock when the lock is in the locked position, and for disengaging the portion when the lock is in the unlocked position. This will prevent removal of the lock itself by unauthorized users. The lock housing preferably encloses at least part of the fastening structure and the engagement structure, such that the adaptor and lock cannot be removed from the firearm when the lock is in the locked position. The design of the adaptor can be readily adapted to fit most firearms, including hand guns and long arms. The adaptor can also be used to provide a manual safety for the firearm.

The adaptor can include moveable structure which is operable with movement of the lock to selectively enable operation of the firearm, or to prevent operation of the firearm. In one embodiment, a moveable lever connected to the adaptor plate can be moved by operation of the lock to selectively block movement of the rebound slide of a firearm. In another embodiment, a lever attached to the adaptor plate can be moved by operation of the lock to block the hammer stirrup of the firearm. In still another embodiment, a lever attached to the Adaptor plate and operable by movement of the lock can be used to move the draw bar of a firearm to selectively prevent operation of the firearm.

The lock is preferably a combination lock having a plurality of push buttons accessible from the exterior of the housing for entering an appropriate combination. A plurality of elongated ratchet members having ratchet teeth can be slidably disposed within the housing. A ratchet return biasing member is provided to return the ratchet members to an initial position. A ratchet pawl is connected to the push buttons and is operable to move the ratchet members against the biasing when the push buttons are depressed. Additional biasing is provided to return the push buttons and ratchet pawl to the starting position. A detent is associated with each ratchet member to prevent the return of the ratchet member to the initial position under the influence of the ratchet return biasing.

A key-way carrier is associated with each ratchet member and is moveable with each ratchet member. A lock slide is positioned adjacent to the ratchet members and includes a plurality of keys. The keys are slidable into the key-ways when the ratchet members and key-way carriers have been depressed an appropriate number of times by operation of the push buttons to align each key-way with the respective key.

The engagement portion of the lock is operatively connected to the lock slide, such that the engagement portion can be moved to the unlocked position only when the key-ways are aligned with the keys of the lock slide according to the appropriate combination. The lock slide and the engagement portion can then move to the unlocked position.

A reset is provided to initialize the ratchet members for locking the lock and to provide a consistent starting point for re-entering the combination. Reset arms are disposed adjacent to the ratchet pawls and detents to move the pawls and detents out of engagement with the ratchet members to release the ratchet members when the reset button is pushed. This will permit the ratchet members to return to the initial position under the influence of the ratchet return spring.

The position of the key-way carriers with respect to the associated ratchet members is preferably adjustable so as to provide for changing the combination of the lock. In a preferred embodiment, the key-way carrier can be inverted so as to present an alternate side of the key-way carrier to the keys of the lock slide. The alternate side has a key-way in a different position, such that the number of operations of the push button necessary to align that key-way with the respective key on the lock slide is changed.

Structure is provided for preventing the operation of the reset button when the lock slide is not fully in the locked position. Structure is also provided for urging the lock slide and keys out of engagement with the key-way carriers to permit substantially free travel of the ratchet members to the initial position during the reset function.

The lock can be used with hand guns and long arms. The lock is particularly useful for engagement of any existing external safety mechanism of the firearm. In the locked position, the engagement portion of the lock prevents movement of the safety to the "unsafe" position, so as to prevent operation of the firearm. In the unlocked position, the engagement portion is moved out of operative engagement with the existing external safety, so as to permit movement of the safety to the "unsafe" position and operation of the firearm.

An embodiment of the invention is useful for locking revolvers, which typically do not have an external safety mechanism. A lever or other member is provided in association with the lock. The lever or other member has a locked position blocking the hammer stirrup or another portion of the firing mechanism of the revolver to prevent operation of the revolver, and an unlocked position permitting operation of the revolver. The lever or other member is moved to the blocking position by movement of the lock slide to the locked position, and can be moved from the blocking position with movement of the lock to the unlocked position. The revolver lock of the invention is also useful with alternative lock constructions.

BRIEF DESCRIPTION OF THE DRAWINGS

There are shown in the drawings embodiments which are presently preferred it being understood, however, that the invention is not limited to the precise arrangements or instrumentalities shown, wherein.

DETAILED DESCRIPTION OF THE PREFERRED EMBODIMENTS

Figure 1:
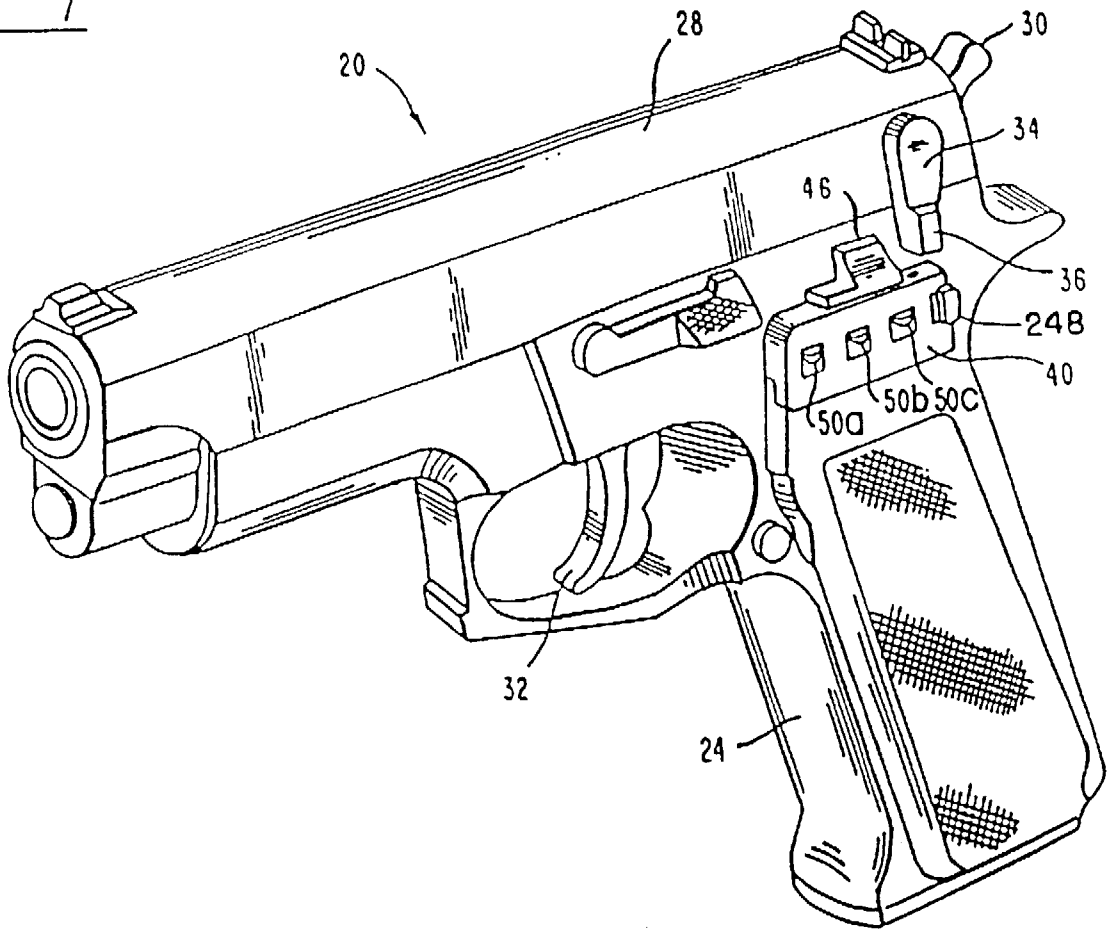
FIG. 1 is a perspective view of an automatic hand gun having a lock according to the invention.
Figure 2:
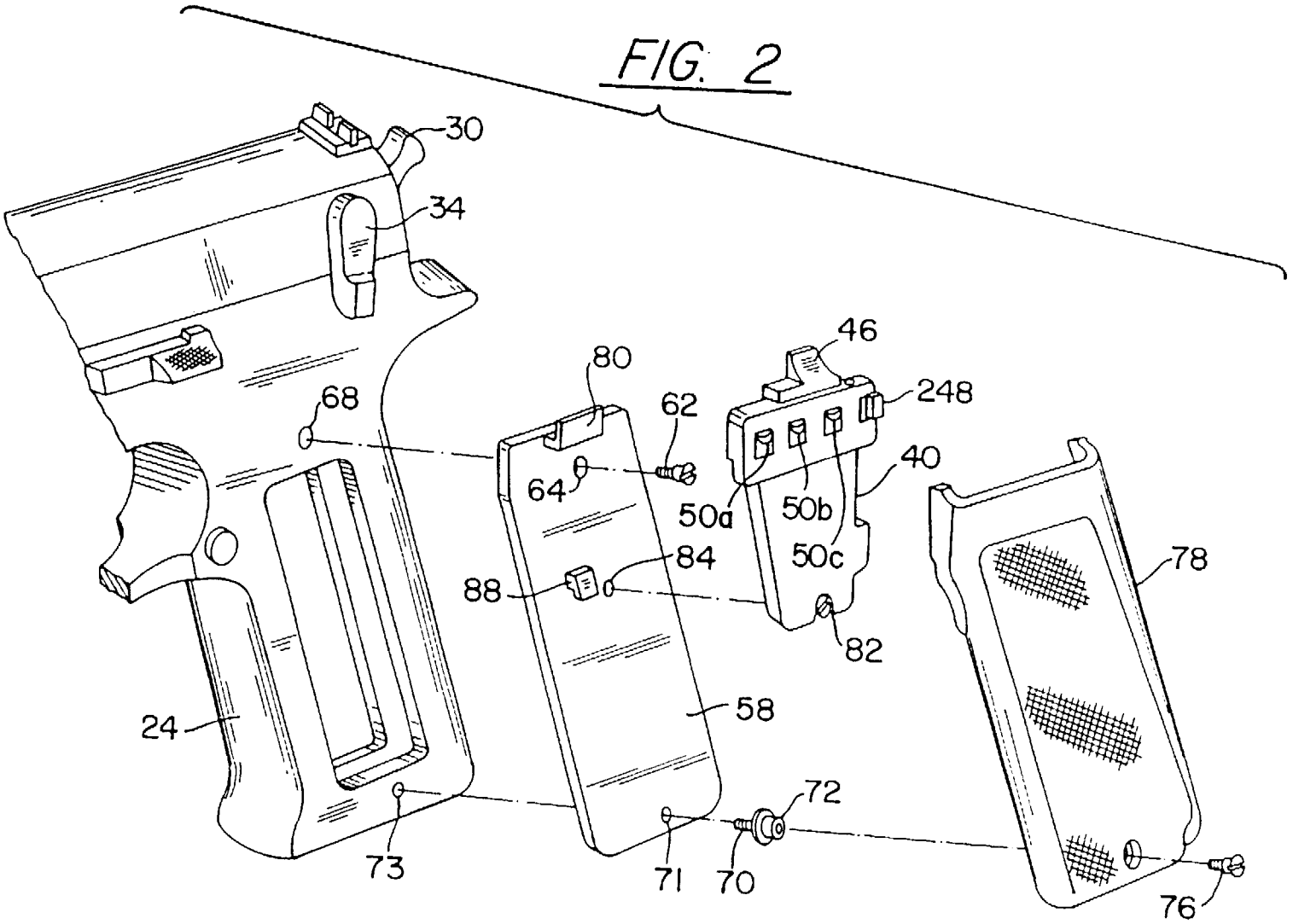
FIG. 2 is an exploded front perspective.

An embodiment of the invention suitable for automatic hand guns is shown in FIGS. 1–7. The hand gun 20 includes a handle frame 24, slide 28, hammer 30, trigger 32, and safety 34, which can be according to known hand gun constructions. The safety 34 is depicted in the "safe" position in FIG. 1. Clockwise pivoting of a finger piece portion 36 of the safety 34 will place the safety in the "unsafe" position, which is necessary to operate the firearm.

A lock 40 according to the invention is provided and includes an engagement portion 46 which, in a locked position, blocks the safety 34 so as to prevent movement of the safety 34 to the "unsafe" position. In an unlocked position, the engagement portion 46 is positioned out of operative engagement with the safety 34 so as so permit the safety 34 to be moved to the "unsafe" position. The firearm can then be operated in the usual manner.

The lock 40 can be constructed according to several alternative lock constructions. Combination locks are most preferred because keys or other pieces are not necessary to unlock the lock. These other pieces can be lost, misplaced, or left behind, which could render the firearm unoperable to the authorized user in an emergency situation. Push buttons 50*a–c* are provided, although fewer or more push buttons can alternatively be utilized. The push buttons 50*a–c* could potentially be replaced by other combination lock structure, such as rotating dials or touch pads.

The precise size and configuration of the handle frame 24 can vary from firearm to firearm. It has been found to be useful to provide an adaptor 58 by which the lock 40 can be mounted to several different types of firearms without substantially changing the lock 40. An adaptor 58 can be attached to the handle frame 24 by suitable structure, such as the screw 62 which passes through aperture 64 in the adaptor 58 to engage a female threaded socket 68 in the handle frame 24. A threaded screw 70 can be positioned through an aperture 71 to secure the adaptor 58 to the handle frame 24 at a female threaded socket 73. The screw 70 can be provided with a female socket 72 at the head so as to receive a screw 76. The screw 76 is useful to secure a handle grip 78 to the handle frame 24. The handle grip 78 can be configured to fit around a portion of the lock 40.

Structure is provided for engaging the lock 40 to the adaptor 58. A flange 80 can be provided which hingably engages cooperating structure on the lock 40. A screw 82 can engage the lock 40 to a threaded socket 84 in the adaptor 58. Further, structure on the lock 40 is preferably provided which, when in the locked position, engages a clasp portion 88 on the adaptor 58 so as to prevent removal of the lock 40 from the adaptor 58 when the lock 40 is in the locked position. The screw 62 used to secure the adaptor 58 to the handle frame 24 is covered by the lock 40, and since the lock 40 cannot be removed from the adaptor 58 when in the locked position, the adaptor 58 also cannot be removed when the lock 40 is in the locked position.

Figure 3:
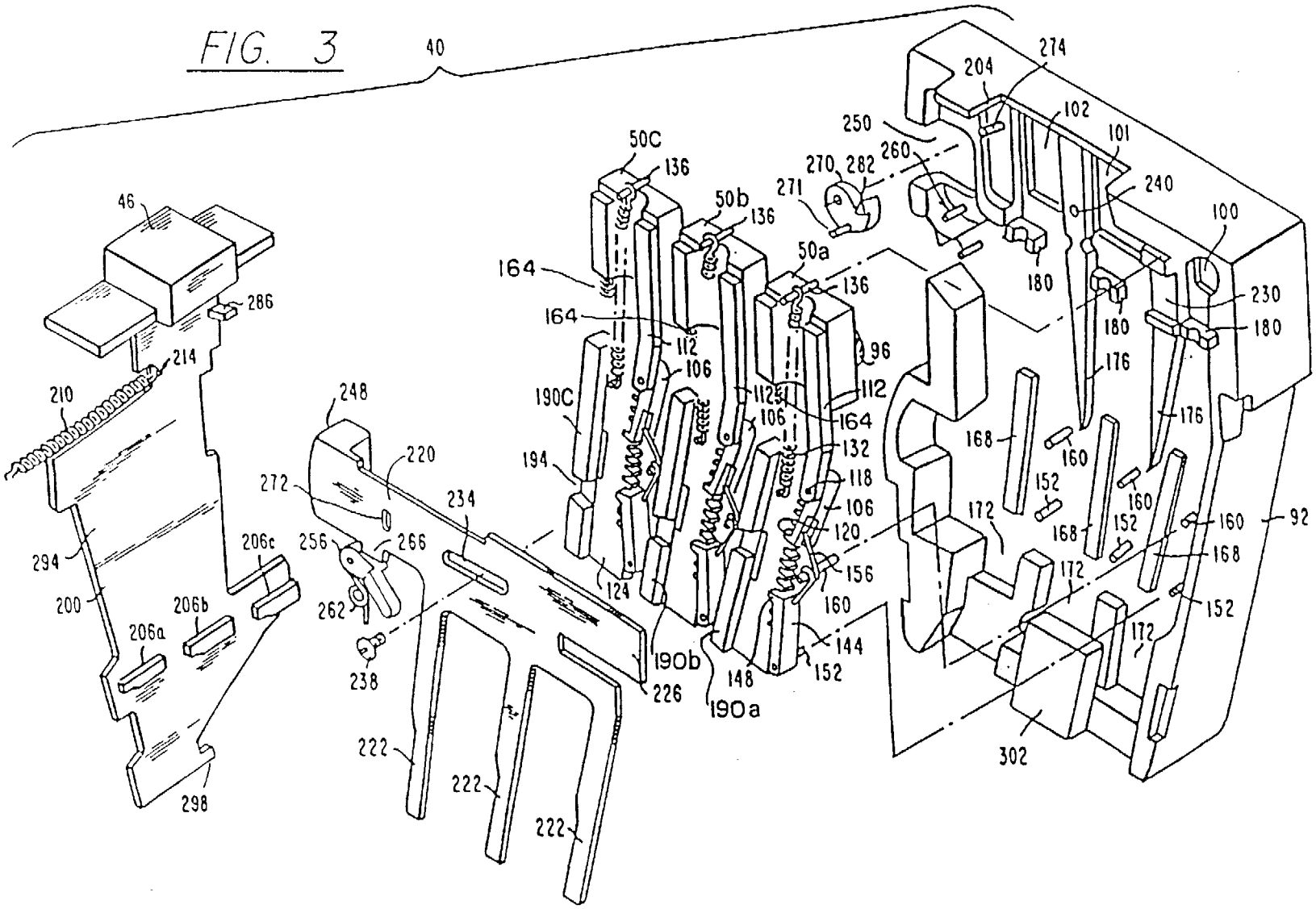
FIG. 3 is an exploded rear perspective of a lock according to the invention.
Figure 4:
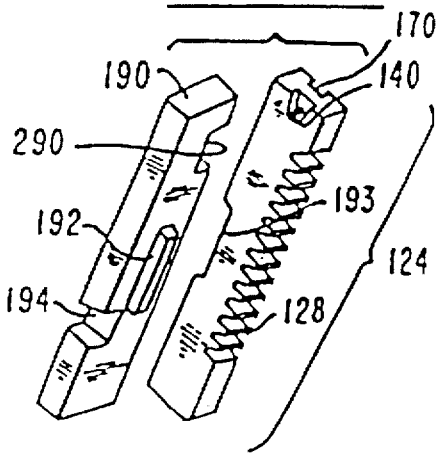
FIG. 4 is an exploded perspective of a ratchet member and keyway carrier.
Figure 5:
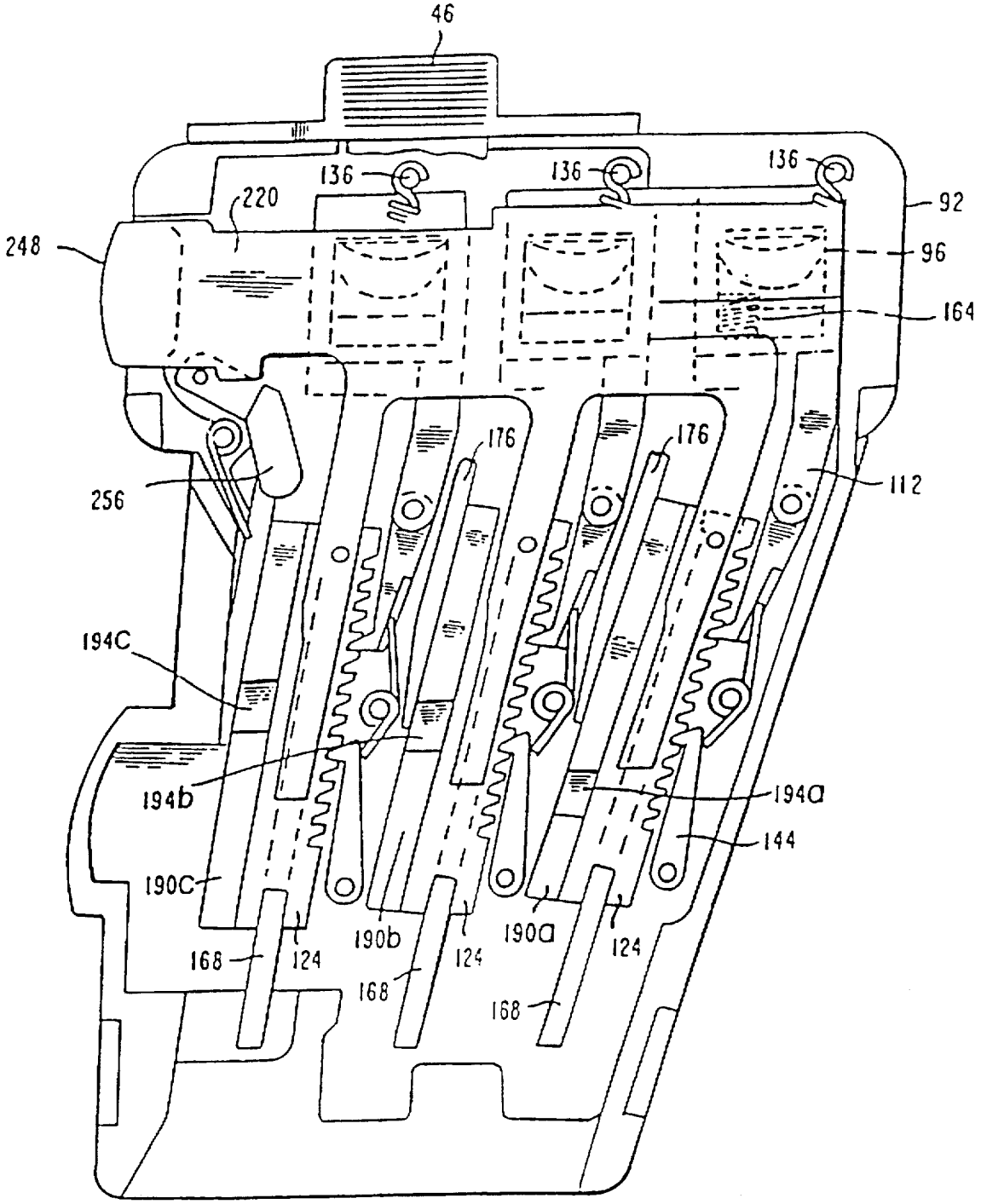
FIG. 5 is a rear elevation, partially broken away and partially in phantom.
Figure 6:
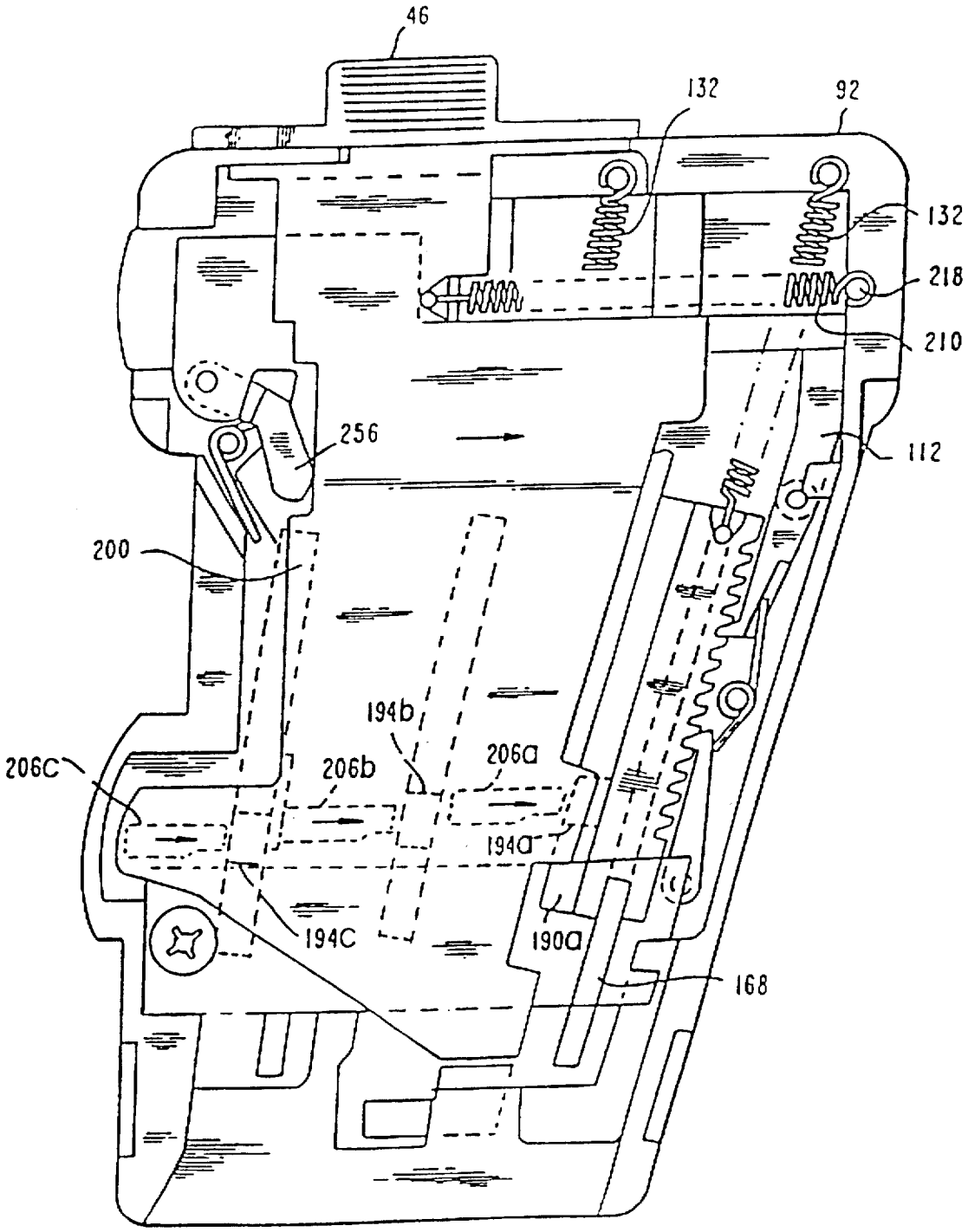
FIG. 6 is a rear elevation, partially in phantom and depicting an unlocked mode of operation.
Figure 7:
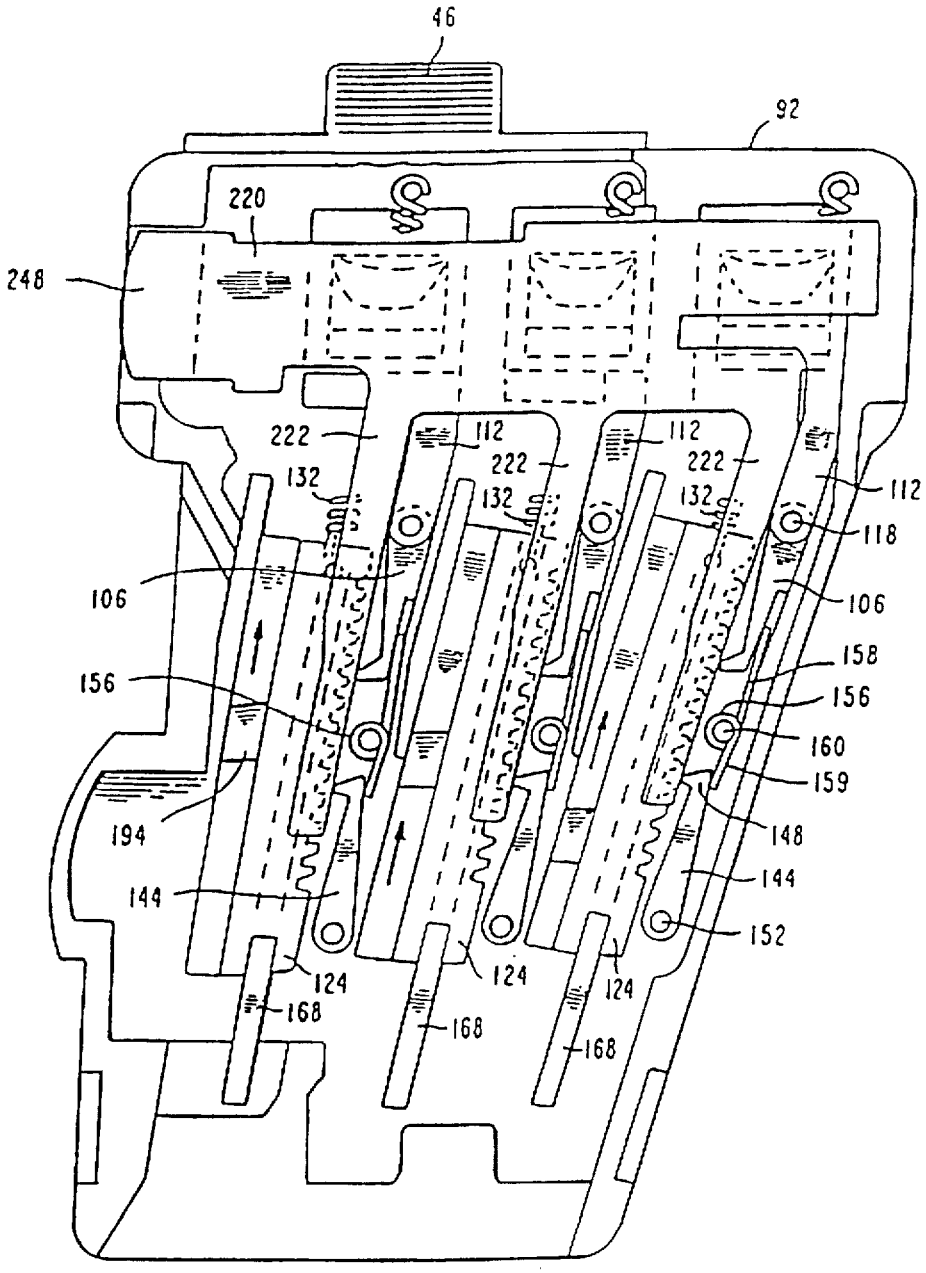
FIG. 7 is a rear elevation similar to FIG. 5, and depicting a reset mode of operation.
Figure 8:
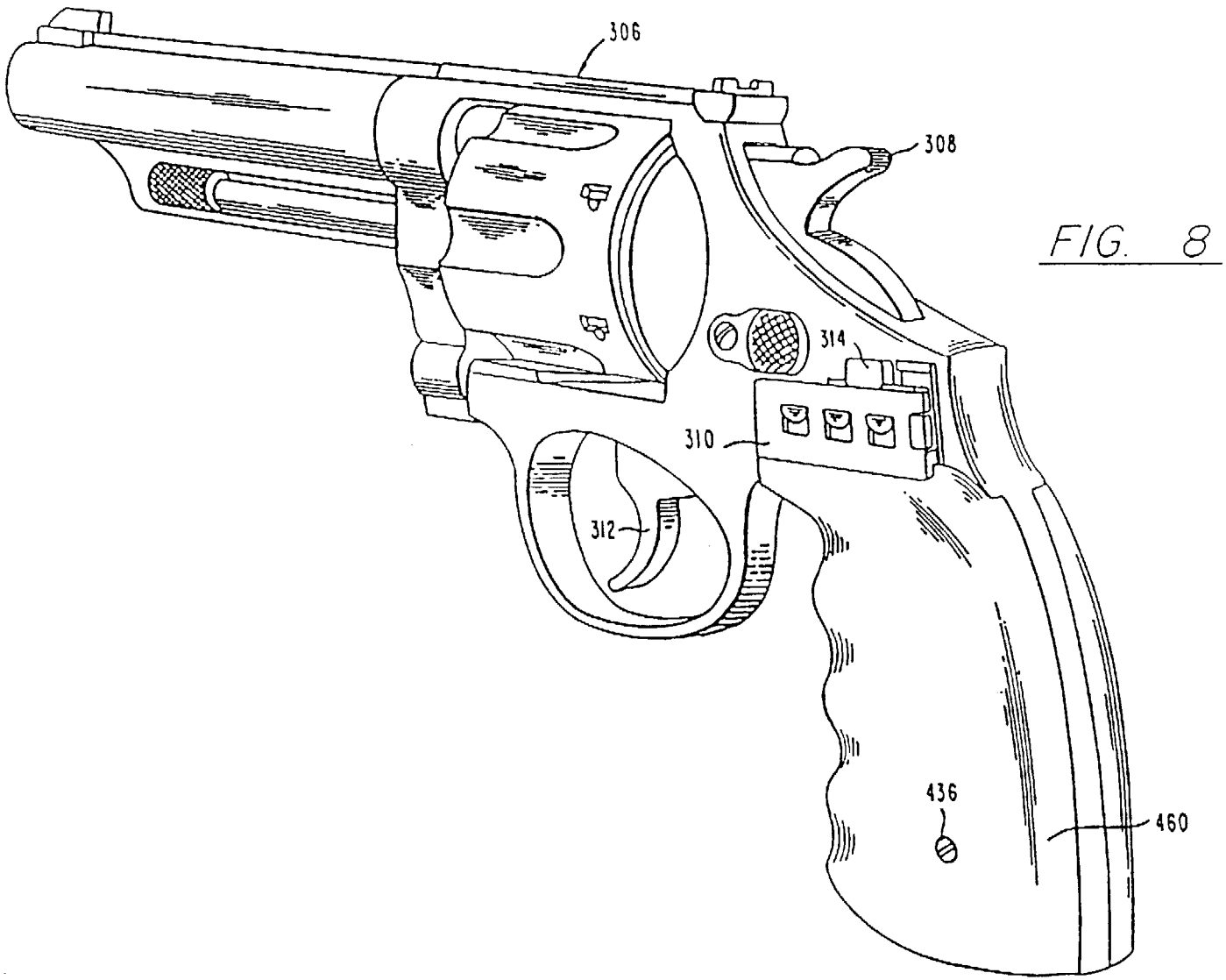
FIG. 8 is a perspective view of a gun lock according to the invention as installed in a revolver.
Figure 9:
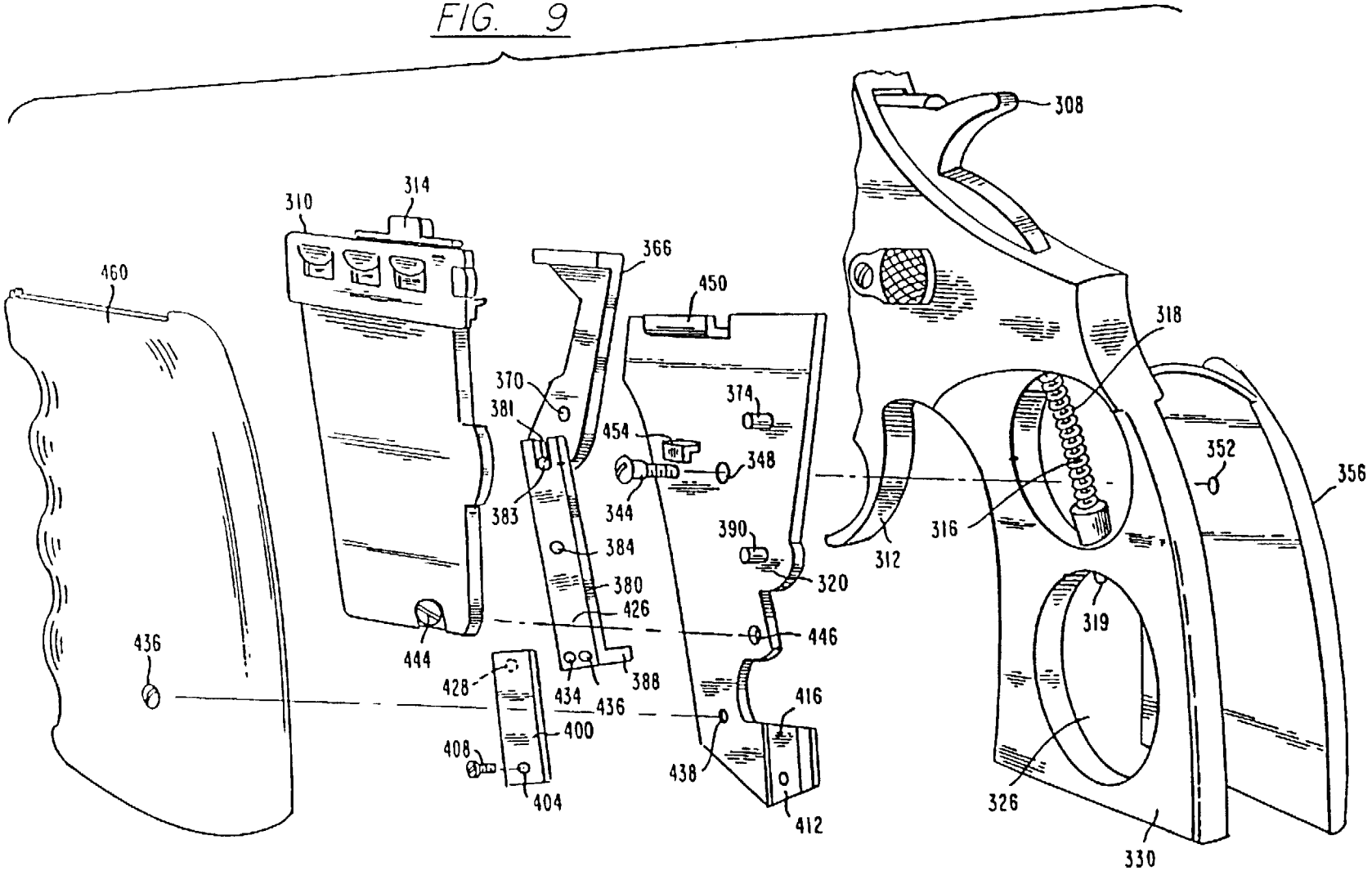
FIG. 9 is an exploded perspective of the embodiment of FIG. 8.

A preferred lock construction is shown in FIG. 3. The lock 40 includes a lock housing 92. A push button finger piece 96 is associated with each of the push buttons 50*a–c* and extends through openings 100–102 that are provided in the housing 92. A pawl 106 is connected to each of the push buttons 50*a–c*. In a preferred embodiment, an extension arm 112 connects each pawl 106 to the push buttons 50*a–c*. The pawls 106 are preferably pivotally connected to the extension arms 112 as by pivot pin 118. Each pawl 106 includes an engagement portion 120 which is adapted to engage an elongated ratchet member 124. The ratchet member 124 can have plurality of ratchet teeth 128 for engagement with the engagement portion 120 of the pawls 106 (FIG. 4). Biasing structure such as a ratchet return spring 132 is adapted to urge the ratchet members 124 toward the respective push buttons 50*a–c*. The ratchet return spring 132 can be secured by mounting pins 136 fixed to the housing 92 and to mounting pins 140 on the ratchet members 124.

Detents 144 are provided to retain each ratchet member 124 against the force of the ratchet return spring 132 following movement of the ratchet member 124 by the pawl 106. The detents 144 can include engagement portions 148 which are adapted to engage the teeth 128 of the ratchet members 124. The detents 144 can be pivotally mounted to the housing 92 by suitable structure such as pivot pins 152.

The pawls 106 and detents 144 preferably are biased into engagement with the ratchet members 124 so as to prevent slippage. One or more biasing springs, such as the biasing spring 156, can be provided to perform this function. The biasing spring 156 can have spring arms 158, 159 which contact the pawls 106 and detents 144. The biasing spring 156 can be mounted in suitable fashion, such as to the mounting posts 160.

The pawls 106 and ratchet teeth 128 are configured according to known ratchet constructions so as to provide for engagement during a downward stroke of the push buttons 50*a–c*, and slippage of the pawl 106 past the ratchet teeth 128 during the return stroke of the push buttons 50*a–c*. Return of the push buttons 50*a–c* is accomplished by push button return springs 164 associated with each of the push buttons 50*a–c*, which are adapted to bias the push buttons 50*a–c* away from the ratchet members 124. The detents 144 are constructed in known fashion so as to engage the ratchet members 124 oppositely to the pawls 106, such that the ratchet teeth 128 can move past the detents 144 when the ratchet members are moved by the pawls 106.

Structure may be provided to guide the sliding movement of the ratchet members 124 and the pawls 106. In one embodiment, rails 168 are provided with the housing 92 and are adapted to slidably engage a groove 170 formed in a back surface of each ratchet member 124. Grooves 172 can be formed in the housing 92 for guiding the movement of the ratchet members. Pawl guides 176 can also be provided with the housing 92 to guide the motion of the pawls 106. Ratchet stops 180 can be provided to limit the movement of the ratchet members 124 in response to the biasing of the ratchet return springs 132.

Key-way carriers 190*a–c* are associated with each of the ratchet members 124 and adapted to move with movement of the ratchet members 124. In a preferred embodiment, the key-way carriers 190 are directly engaged to the ratchet members 124, such as by tongue 192 and groove 193 construction. Each key-way carrier 190*a–c* includes a respective key-way 194*a–c*, which can be formed as a notch or groove therein.

A lock slide 200 is operatively connected to the engagement portion 46 and can extend through a suitable opening 204 in the housing 92. The lock slide 200 includes keys 206*a–c* which, when assembled, are positioned substantially adjacent to respective key-way carriers 190*a–c*. The lock slide 200 and keys 206*a–c* are juxtaposed to the key-way carriers 190*a–c* such that transverse movement of the lock slide 200 relative to the key-way carriers 190*a–c* is blocked by contact between the keys 206*a–c* and the keyway carriers 190*a–c*.

The key-ways 194*a–c* are dimensioned to accept the keys 206*a–c*. Alignment of the key-ways 194*a–c* with the keys 206*a–c* is accomplished by depressing the respective push buttons 50*a–c* the appropriate number of times corresponding to the position of the key-ways 194*a–c* on the respective key-way carriers 190*a–c*. A keyway 194 that is positioned nearer to the end of the ratchet member 124 that is closest to the respective push button 50 will require more operations of the push button 50 in order to move the ratchet member 124 and associated key-way carrier 190 a sufficient distance to align the key-way 194 with the respective key 206. Different positions of the key-way 194 on the key-way carrier 190 will require more or fewer operations of the push button 50. Accordingly, the relative positioning of the key-ways 194*a–c* on the respective key-way carriers 190*a–c* corresponds to a combination necessary to align all of the key-ways 194*a–c* with the keys 206*a–c*, so as to permit transverse movement of the keys 206*a–c* into the key-ways 194*a–c*, and corresponding movement of the lock slide 200. The engagement portion 46 will move with the lock slide 200 to the "unlocked" position.

A lock slide biasing spring 210 can be provided to urge the lock slide 200 to the unlocked position in which the keys 206*a–c* are urged into the key-ways 194*a–c*. The biasing spring 210 can be mounted to the lock slide 200 at a mounting post 214, and can be engaged to a portion of the housing at a post 218 (FIG. 4).

Reset structure is provided for returning the ratchet members 124 to an initial position, which will move the key-ways 194 out of alignment with the keys 206 to lock the lock 40, and so that the combination can be entered from a consistent starting point. The reset structure can engage the pawls 106 and detents 144 to move them out of engagement with the ratchet members 124. The ratchet return springs 132 will move the ratchet members 124 to an initial position defined by the ratchet stops 180. A reset slide 220 can be provided with a plurality of reset arms 222. The reset slide 220 is so constructed that, when assembled, the reset arms 222 are juxtaposed to the pawls 106 and detents 144, which extend somewhat out of the plane of the ratchet members 124. The reset slide 220 is slidably disposed within the lock, and can be supported by a portion 226 which is slidably engaged in a slot 230 formed in the housing 92. A slot 234 can be provided to receive a mounting screw 238, which engages a threaded socket 240 in the housing 92 so as to provide slidable engagement of the reset slide 220 to the housing 92. A reset button 248 of the reset slide 220 can extend out of an opening 250 in the housing 92 for manipulation by the operator. Sliding movement of the reset slide 220 will cause contact between the reset arms 222 and the pawls 106 and detents 144 to move the pawls 106 and detents 144 out of engagement with the ratchet teeth 128 of the ratchet members 124.

In operation, when the lock slide 200 is in the locked position, the engagement portion 46 will be positioned so as to prevent movement of the safety 34 from the "unsafe" position. Keys 206*a–c* abut the respective key-way carriers 190*a–c* such that movement of the lock slide 200 to the unlocked position is not possible. Upon operation of the respective push buttons 50*a–c*, the key-ways 194*a–c* are aligned with the keys 206*a–c*. The lock slide 200 is urged by the lock slide spring 210 such that the keys 206*a–c* are moved into the respective key-ways 194*a–c*. The lock slide 200 and engagement portion 46 thereby are permitted to move from the locked position to the unlocked position, permitting movement of the safety 34 to the "unsafe" position, and operation of the firearm. Locking of the firearm can be accomplished by manually moving the engagement portion 46 and lock slide 220 to the locked position in which the keys 206*a–c* are out of engagement with the key-ways 194*a–c*. The lock slide 220 must be held against the biasing of the lock slide spring 210, so that accidental locking is avoided. Movement of the reset button 248 and reset slide 220 will cause the reset arms 222 to move the ratchet pawls 106 and the detents 144. This will permit movement of the ratchet members 124 and associated key-way carriers 190*a–c* to the initial position in which movement of the keys 206*a–c* is blocked by the key-way carriers 190*a–c*. This will lock the lock 40 and will also position each of the ratchet members 124 at the initial position defined by the ratchet stops 180 for subsequent entering of the combination.

Movement of the pawls 106 and detents 144 out of engagement with the ratchet members 124 prior to the completion of the movement of the keys 206*a–c* out of the respective key-ways 194*a–c* can result in dragging of one or more of the keys 206*a–c* against sides of the respective key-way carriers 190*a–c*. This will impede the return of the key-way carrier 190 and respective ratchet member 124 to the initial position during the reset function. The subsequent release of the reset button 248 will cause the ratchet pawls 106 and detents 144 to engage the respective ratchet member 124, which may not have returned fully to the initial position because of the dragging against the keys 206. Entering of the appropriate combination will be confused because the ratchet member 124 and key-way carrier 140 will not be in the true starting position. It is therefore desirable to provide structure to ensure that the reset button 248 is not operable until the lock slide 200 and keys 206*a–c* are completely out of engagement with key-way carriers 190*a–c*.

A pivoting reset stop lever 256 can be provided and can be pivotally secured to the housing 92 as by a mounting pin 260. A spring 262 biases the reset stop lever 256 into engagement with a shoulder 266 on the reset slide 220. Completion of the movement of the lock slide 200 to the locked position causes contact between the lock slide 200 and the reset stop lever 256 so as so pivot the lever out of engagement with the reset slide 220. The reset slide 220 can then be operated to reset the position of the ratchet members 124.

It is also desirable that structure be provided to urge the lock slide 200 completely out of engagement with the key-way carriers 190*a–c* during the reset function. The lock slide spring 210 may otherwise cause some contact between the keys 206*a–c* and the key-way carriers 190*a–c*. A reversing lever 270 can be pivotally mounted to the housing 92, as by a mounting pin 274. The reversing lever 270 includes a pin 271 that is contacted by an elongated slot 272 on the reset slide 220 when the reset slide is moved during the reset operation. The contact will pivot the reversing lever 270 and cause a shoulder 282 of the reversing lever 270 to contact a shoulder 286 of the lock slide 200 to urge the lock slide 200 and keys 206*a–c* securely out of engagement with the key-way carriers 190*a–c*.

The key-way carriers 190 can include alternate key-ways 290 substantially on a side of the key-way carrier 190 opposite the key-way 194. The fastening structure such as the tongue 192 and groove 193 is such that the key-way carrier 190 can be inverted to face the alternate key-way 290 to the lock slide 200 and keys 206. The alternate key-way 290 can be at a different position along the key-way carrier 190 such that inversion of the key-way carrier 190 will result in alteration of the combination necessary to align the alternate key-way 290 with the respective key 206 to open the lock. The combination can thereby be readily changed if it becomes known to unauthorized users.

It is preferable that structure be provided to prevent the removal of the lock itself by unauthorized users and, as stated earlier, a catch 88 on the adaptor 58 can be aligned with a cooperating catch 302 on the lock housing 92. A portion 298 of the lock slide 200 moves behind the catch 88 and in front of the catch 302 when the lock slide 200 is in the locked position. The adaptor 58, lock slide 200, and housing 92 will thereby be interconnected to secure the lock 40 to the adaptor 58 when the lock 40 is in the locked position. Further, the lock housing 92 covers and prevents access to the mounting screw 62, which secures the adaptor 58 to the frame 24. The interconnecting structure provides a construction whereby the lock 40 cannot be removed from the hand gun when the lock 40 is in the locked position.

The principles disclosed herein can be applied to locks having different component configurations. For example, it is possible to construct a lock by which the keys are provided with the ratchet member and the key-ways are provided on the lock slide. Also, the keys and key-ways can be altered to various forms of protrusions and depressions, the alignment of which will permit movement of one relative to the other. Other variations as would be apparent to one skilled in the art would also be possible.

An alternative embodiment of the invention is useful for revolvers. Revolvers do not include an external safety mechanism, and accordingly, another portion of the firing mechanism must be operatively engaged in the locked position to prevent operation of the firearm. FIGS. 8–11 depict such an embodiment of the invention for a revolver 306. In this embodiment, a lock 310 is provided with an engagement portion 314. The lock 310 can be similar in construction to the lock 40 described above, or can be made according to a different construction, including locks that are not combination locks.

Operation of the firearm 306 requires rearward pivoting of a hammer 308 upon squeezing of a trigger 312. A hammer stirrup 316 is engaged to the hammer 308 according to known firearm constructions. A hammer return spring 318 is provided to propel the hammer stirrup 316 and hammer 308 during firing of the weapon. An end 319 of the hammer stirrup 316 in some firearm constructions extends into an opening 326 of the frame 330 of the firearm.

An adaptor 320 can be provided and secured to the firearm 306 by suitable fastening structure. In one embodiment, a screw 344 is passed through an aperture 348 in the adaptor 340 and engaged to a suitable socket 352 in an opposing handle grip 356. The adaptor 320 will then be secured to the frame 330 of the firearm 306.

A lever 366 is provided and can be pivotally mounted to the adaptor 340 through a mounting aperture 370 which is secured to a mounting pin 374 on the adaptor 320. A second, blocking lever 380 is pivotally mounted to the adaptor 320, as by a mounting aperture 384 which is positioned on a mounting post 390 of the adaptor 320. The first lever 366 can be engaged to the blocking lever 380 by a suitable engagement post 381 on the first lever 366, which cooperates with an engagement groove 383 on the blocking lever 380.

Figure 10:
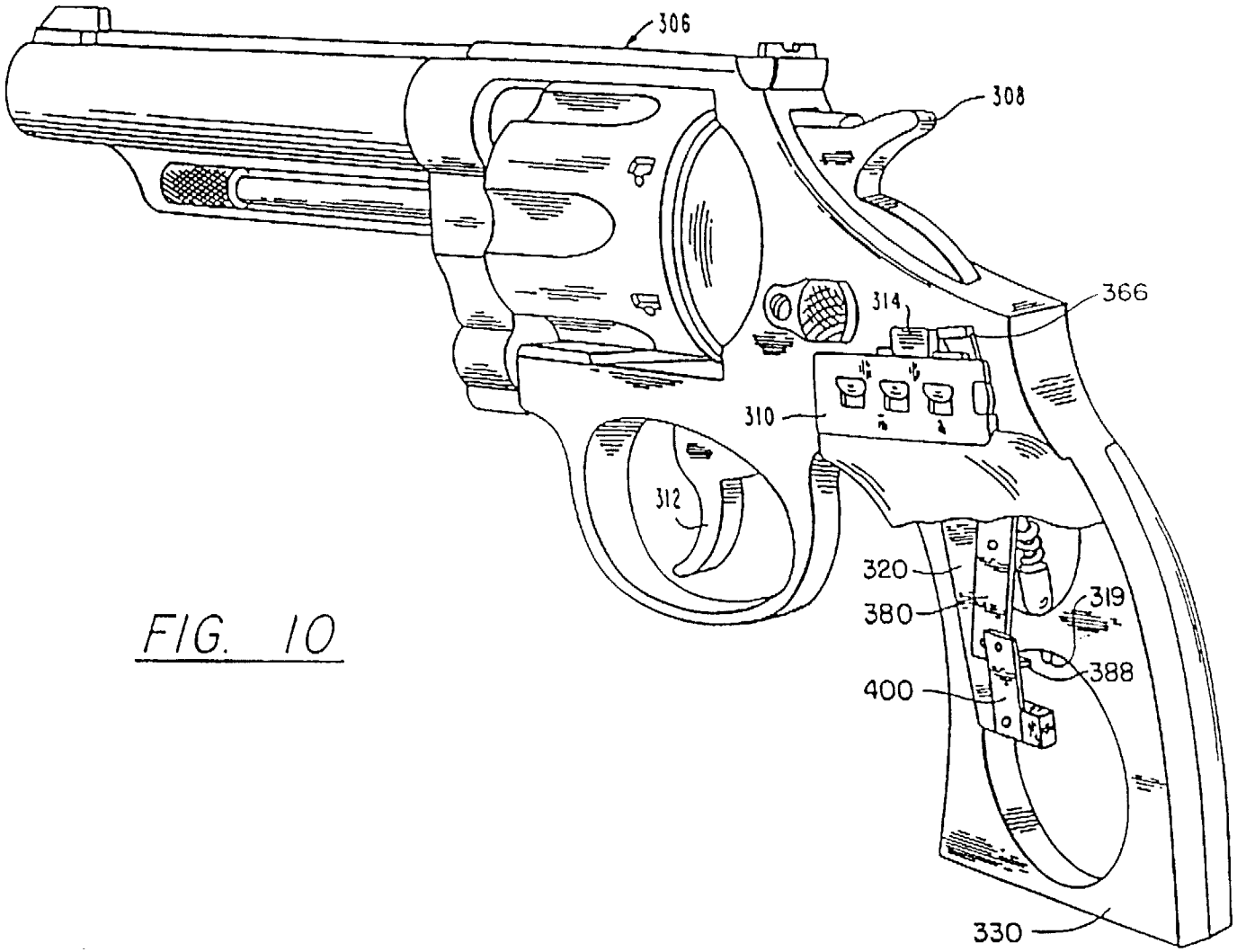
FIG. 10 is a perspective, partially broken away, and in an unlocked mode of operation.
Figure 11:
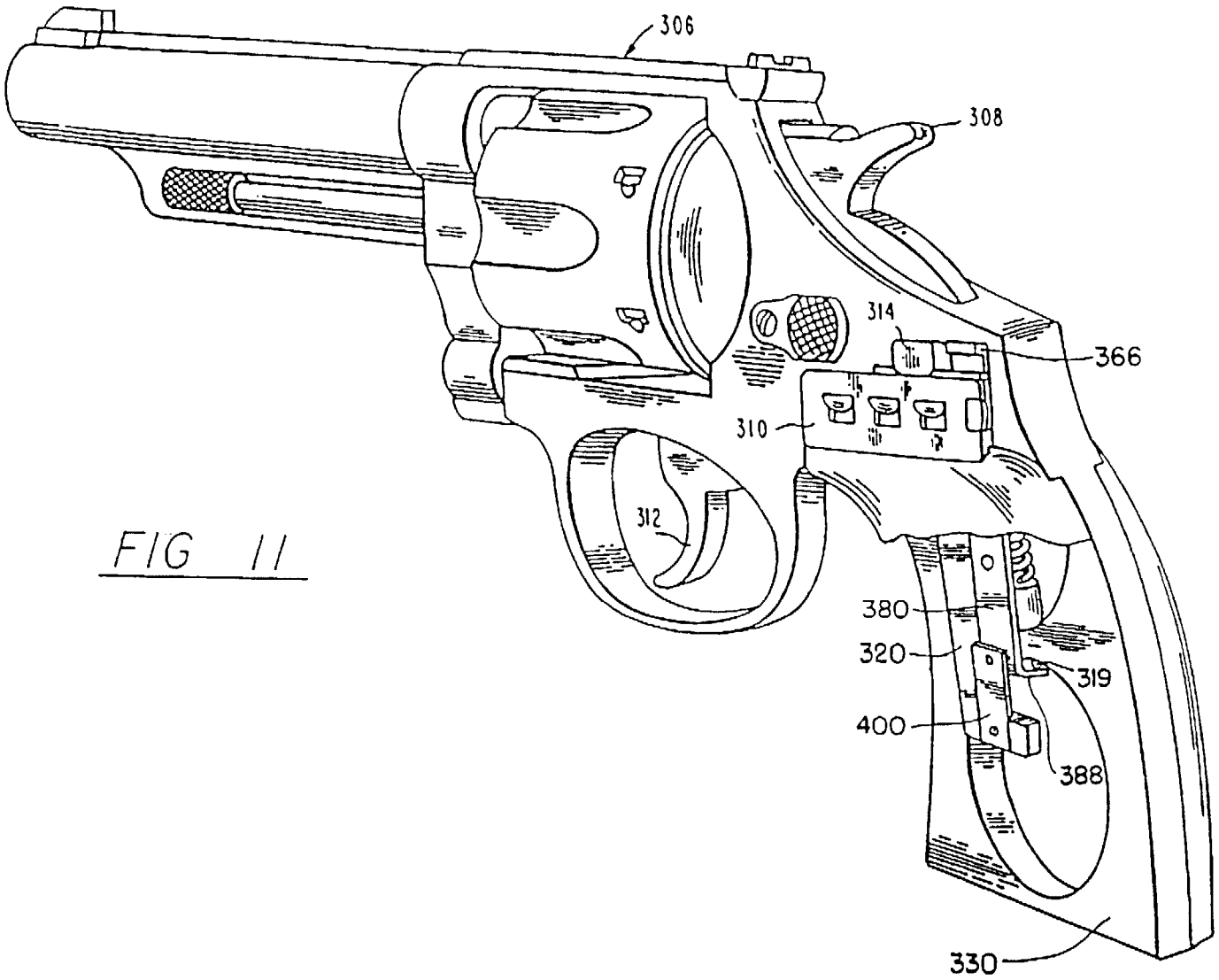
FIG. 11 is a perspective, partially broken away, and in a locked mode of operation.

In a first, unlocked position, the blocking lever 380 is positioned out of alignment with the end 319 of the hammer stirrup 316 (FIG. 10). Normal operation of the firearm is thereby permitted. In a locked position, however, the engagement portion 314 engages and pivots the first lever 366 clockwise and secures it in this pivoted position. Pivoting of the first lever 366 causes counter-clockwise pivoting of the blocking lever 380. A blocking portion 388 of the blocking lever 380 is moved over the end portion 319 of the hammer stirrup 316 to prevent movement of the hammer stirrup 316 and operation of the weapon.

Structure can be provided to fix the position of the blocking lever 380. A suitable spring 400, such as a leaf spring, can be secured through a mounting aperture 404 by a screw 408, which engages a suitable socket 412 in the adaptor 320. A groove 416 in the adaptor 320 is adapted to receive a portion of the leaf spring 400 and provides additional fastening structure. The spring 400 includes either of a tit or a dimple to cooperate with two corresponding tits or dimples on a surface 426 of the blocking lever 380. A dimple 428 can engage either of tits 434, 436 to secure the blocking lever in either the locked or unlocked position.

The lock 310 can be secured to the adaptor 320 by suitable structure such as a screw 444 which engages a suitable threaded opening 446 on the adaptor 320. A flange 450 can be provided to engage a corresponding portion of the lock 310. Further, a catch 454 can be provided to engage a portion of the lock, such as a portion of the lock slide as previously discussed, to prevent removal of the lock 310 from the adaptor 320 when the lock is in the locked position. The lock also covers the mounting screw 344 such that an interconnecting structure is provided wherein the lock 310 cannot be removed from the firearm 306 when the lock 310 is the locked position. A handle grip 460 can be fashioned to fit over the lock 310 and secure to the adaptor 320 as by a screw 436 engaging an aperture 438.

The safety mechanism of the invention can be used, with minor modification, in gun designs of many descriptions. The operation of most hand guns and long arms is well understood, and described in several volumes including the Gun Digest Book of Firearms Assembly/Disassembly, Parts I and II; Automatic Pistols and revolvers, by J. B. Wood, D.B.I. Books, Inc., Northbrook, Ill., 1979; The S&W Revolver, A Shop Manual, Jerry Kuhnhavsen, V.S.P. Publishers, Department 1A, Box 1966, Tusten, Calif. 92681; The Colt 45 Automatic, A Shop Manual, Jerry Kuhnhavsen, V.S.P. Publishers, Department 1A, Box 1966, Tusten, Calif. 92681; and the NRA Guide to Firearms Assembly, National Rifle Association of America, 1600 Rhode Island Avenue N.W., Washington, D.C. 20036. The disclosures of the above-identified references are herein fully incorporated by reference. The invention can be utilized with automatic firearms such as the Beretta model 84BB, manufactured by the Fabbrica d'ArmiPietro Beretta S.P.A. of Via Pietro Beretta, 18-25063 Gardone Val Trompia, Brescia, Italy. The weapon is fully described in the Owner's Manual Beretta dal 1526, Series 81, distributed by the company, which manual hereby is fully incorporated by reference. The invention can also be utilized with the Smith & Wesson semiautomatic centerfire pistols, manufactured by the Smith & Wesson Company of 2100 Roosevelt Avenue, Springfield, Mass. The weapons are fully described in the Safety Instruction & Parts Manual, distributed by the company, which manual is hereby fully incorporated by reference. Suitable lock structures are also disclosed in Applicant's U.S. Pat. Nos. 4,987,693 and 5,090,148, and Applicant's co-pending applications. The disclosures of these patents and applications are hereby incorporated fully by reference.

The type of lock that is used can be selected from a number of suitable lock designs. Desirable features include tamper resistance and a reduced size which will not interfere with normal operation of the firearm. It is also desirable that the lock be operable without the assistance of external accessories such as keys, which can be lost or misplaced and are difficult to manipulate in an emergency. It further is desirable that dials and other similar lock-opening constructions be avoided, as these cannot be utilized in dark environments and are also difficult to manipulate in an emergency. In a preferred embodiment, the lock includes push buttons which operate to unlock the lock when the buttons have been pressed a proper number of times or in a proper sequential order.

Figure 12:
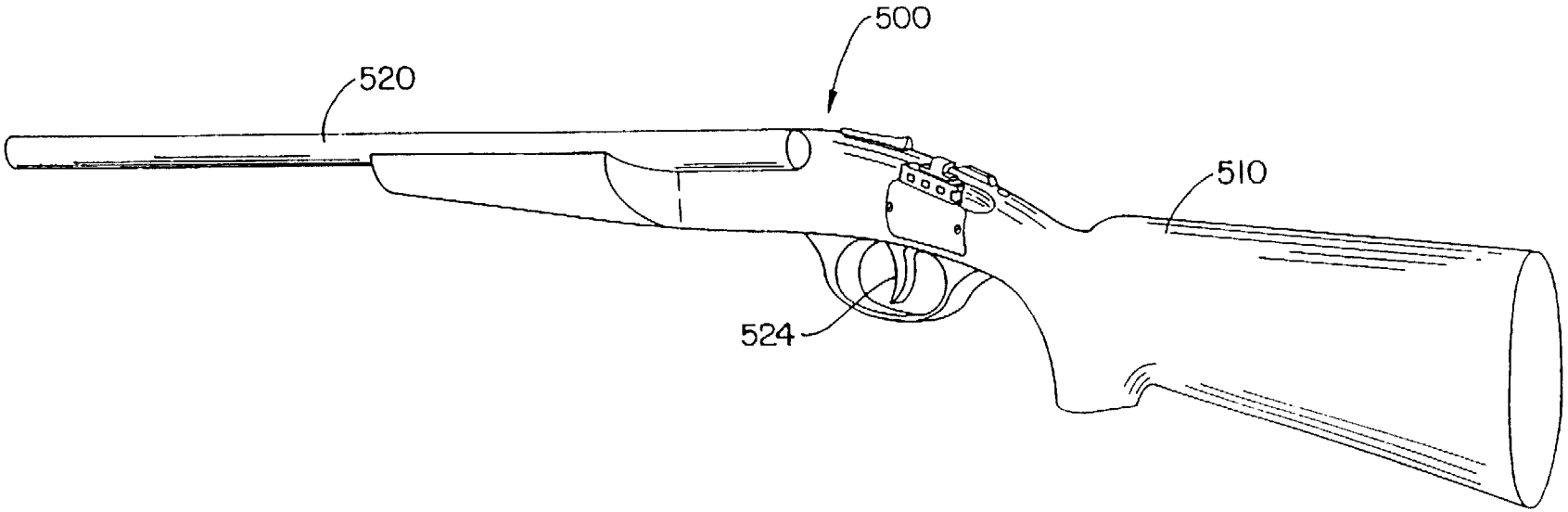
FIG. 12 is a perspective view of a long arm having a lock according to the invention.
Figure 13:
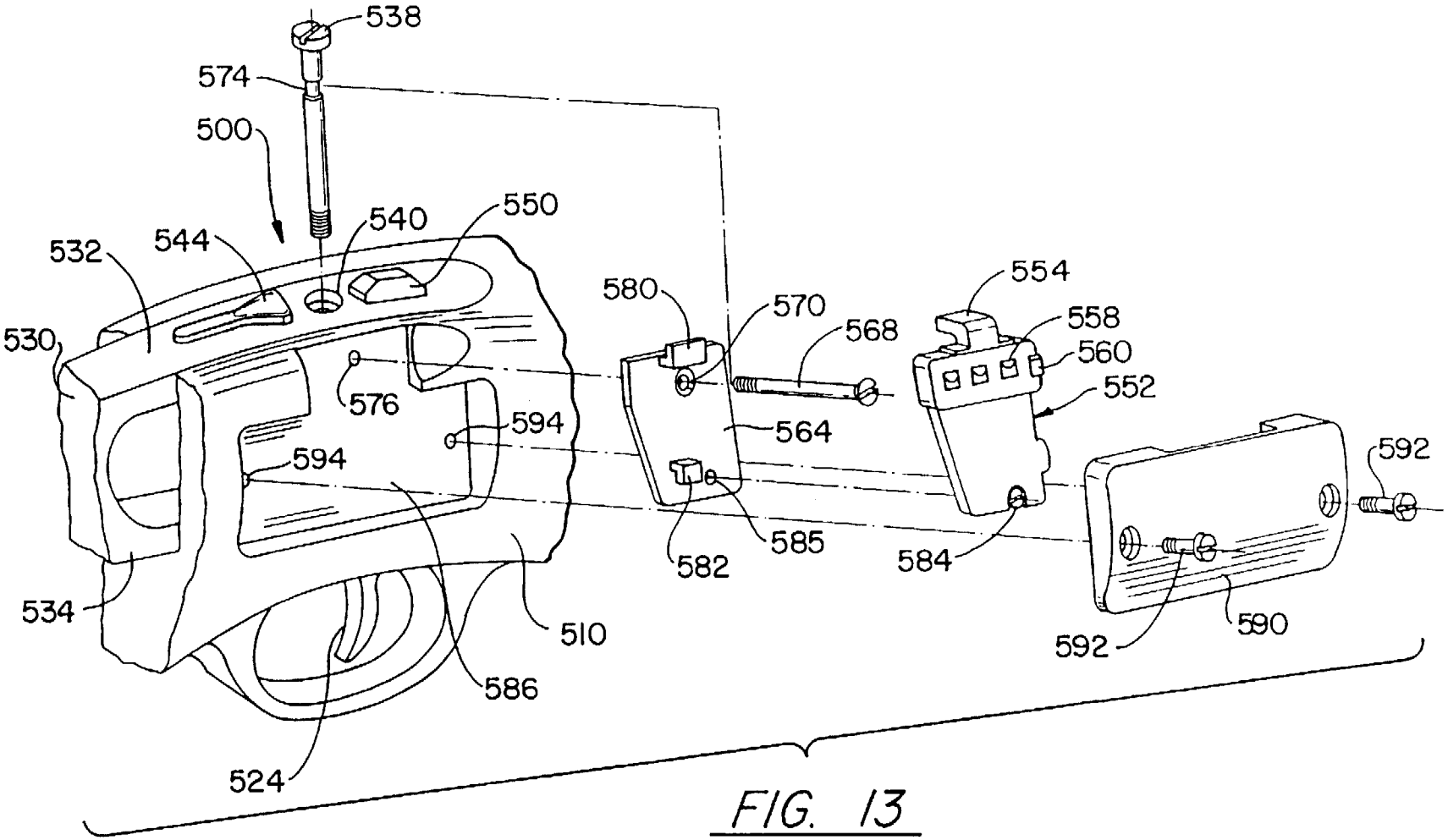
FIG. 13 is an exploded perspective, partially broken away.

There is shown in FIGS. 12–13 an adaptation of the invention for long arms. The principles of the invention as applied to hand guns are equally applicable to long arms, namely, that a combination lock can be applied to a long arm. The lock has a portion capable of operatively engaging a portion of the firing mechanism of the long arm so as to prevent operation of the long arm. The lock has an unlocked position in which operation of the long arm is permitted. The lock can be adapted to cooperate with an existing exterior safety of the long arm, or alternatively, can be adapted to operatively engage an internal portion of the firing mechanism.

The long arm 500 includes a stock 510, barrel 520, and trigger 524. The stock 510, according to some long arm constructions, has an opening that is adapted to engage the receiver portion 530 of the frame of the long arm. The receiver portion 530 can include top tang 532 and bottom tang 534. Suitable fastening structure such as a receiver bolt 538 passes through an aperture 540 in the receiver portion 530 and engages a corresponding portion of the stock 510 to secure the stock 510 to the receiver portion 530. A barrel release 544 is sometimes provided to permit "breaking" of the long arm for loading and unloading purposes. An exterior safety 550 is commonly provided and is moveable between "safe" and "unsafe" positions which will respectively prevent or permit operation of the firearm. The movement of the safety necessary to operate the long arm varies according to the manufacturer, but in the presently disclosed embodiment, sliding movement of the safety 550 forward results in the "unsafe" position necessary for operation of the firearm.

A lock 552 can be secured to the stock 510 or to another portion of the firearm that is external to the receiver portion 530. The lock 552 is secured to the firearm by suitable structure, which can include screws. The lock 552 has an engagement portion 554 that is moveable between locked and unlocked positions. In the locked position, the engagement portion 554 operatively engages the external safety 550 to prevent movement of the safety to the unlocked position. In the firearm shown in the drawing, the engagement portion 554 in the locked position prevents forward movement of the external safety 550. In the unlocked position, the engagement portion 554 moves to a position permitting forward movement of the external safety 550 to the unlocked, "unsafe" position. Combination entering structure such as buttons 558, and a reset button 560, can be provided with the lock 552 as previously described and as described in Applicant's other applications and patents.

The lock 552 is preferably mounted to the long arm 500 by a adaptor 564. Suitable structure such as a stock bolt 568 can pass through an aperture 570. An aperture 574 can be provided in the stock 510 to permit passage of the stock bolt 568, which will pass between the top tang 532 and the bottom tang 534 of the receiver portion 530 and engage a suitable threaded opening in an opposing portion of the stock 510. In a preferred embodiment, the lock is positioned such that the stock bolt 568 substantially aligns with the receiver bolt 538 when each is installed. The receiver bolt 538 becomes operatively engaged to the stock bolt 568 so as to prevent the removal of the receiver bolt 538 unless the bolt 568 is first removed. In one embodiment, the receiver bolt 538 includes a groove 574 through which the stock bolt 568 passes when the stock bolt 568 is engaged to the stock 510. Other interlocking constructions are possible, such as slots, catches and the like.

The lock 552 can be secured to the adaptor 564 by a latch 580 as previously described. A catch 582 functions as previously described to lock the lock 552 to the adaptor 564 when the lock 552 is in the locked position. This will prevent access to the stock bolt 568 and removal of the lock. A screw 584 can be utilized to engage an aperture 585 in the adaptor 564.

A well 586 can be provided in the stock 510 to receive the adaptor 564 and the lock 552. A decorative cover 590 can be secured by screws 592. The screws 592 can engage suitable apertures 594 in the stock 510. It is alternatively possible that the lock 552 will be configured to engage an internal portion of the firing mechanism. In this instance, a suitable opening would be provided in this stock 510 to permit access to the interior of the long arm 500.

The locks described in the above embodiments of the invention require the user to enter the combination selection in the form of a predetermined number of discrete depressions of each button. Other combination selections are contemplated. For example, the combination could require the user to depress a plurality of buttons in a proper sequential order. Other types of lock mechanisms are also known in the art, and are within the scope of the present invention. The lock described can also have utility as a lock for items other than firearms, such as suitcases, briefcases, and jewelry boxes.

The invention provides an adaptor that includes structure for connecting the adaptor to the firearm, preferably the frame of the firearm. These include the adaptors 58, 320 and 564 disclosed herein, as well as modifications within the scope of the invention. The adaptor can include structure for engaging at least a portion of the firing mechanism of the firearm so as to prevent operation of the firearm. The adaptor 320 shown in FIGS. 9–11 includes pivotable levers 366, 380 which will accomplish this purpose. The levers, in some embodiments, can be manipulated manually to provide a manual safety for handguns which do not have an existing manual safety. The adaptor will most often be utilized with a lock in the manner disclosed herein so as to provide a means for selectively permitting or preventing operation of the firearm. The adaptor preferably has structure for connecting the adaptor to the lock when the lock is in the locked position so as to prevent unauthorized removal of the lock from the adaptor. This is shown by the clasp 88 of the adaptor 58, and the clasp 454 shown in FIG. 9. A portion of the lock, or structure operatively connected to the lock, preferably covers structure which is utilized to secure the adaptor to the firearm. In this manner, an interlocking structure is provided by which the lock, when in the locked position, cannot be removed from the adaptor, and the adaptor cannot be removed from the firearm.

It is possible to use an adaptor according to the invention with handguns of many different designs, including both revolvers and automatics, as well as long arms. The adaptor can be utilized with a variety of a variety of different lock designs, including those described in the present application and applicant's other applications and patents, as well as other unrelated lock constructions. The adaptor can also be combined with a grip to provide ready installation into the firearm.

Figure 14:
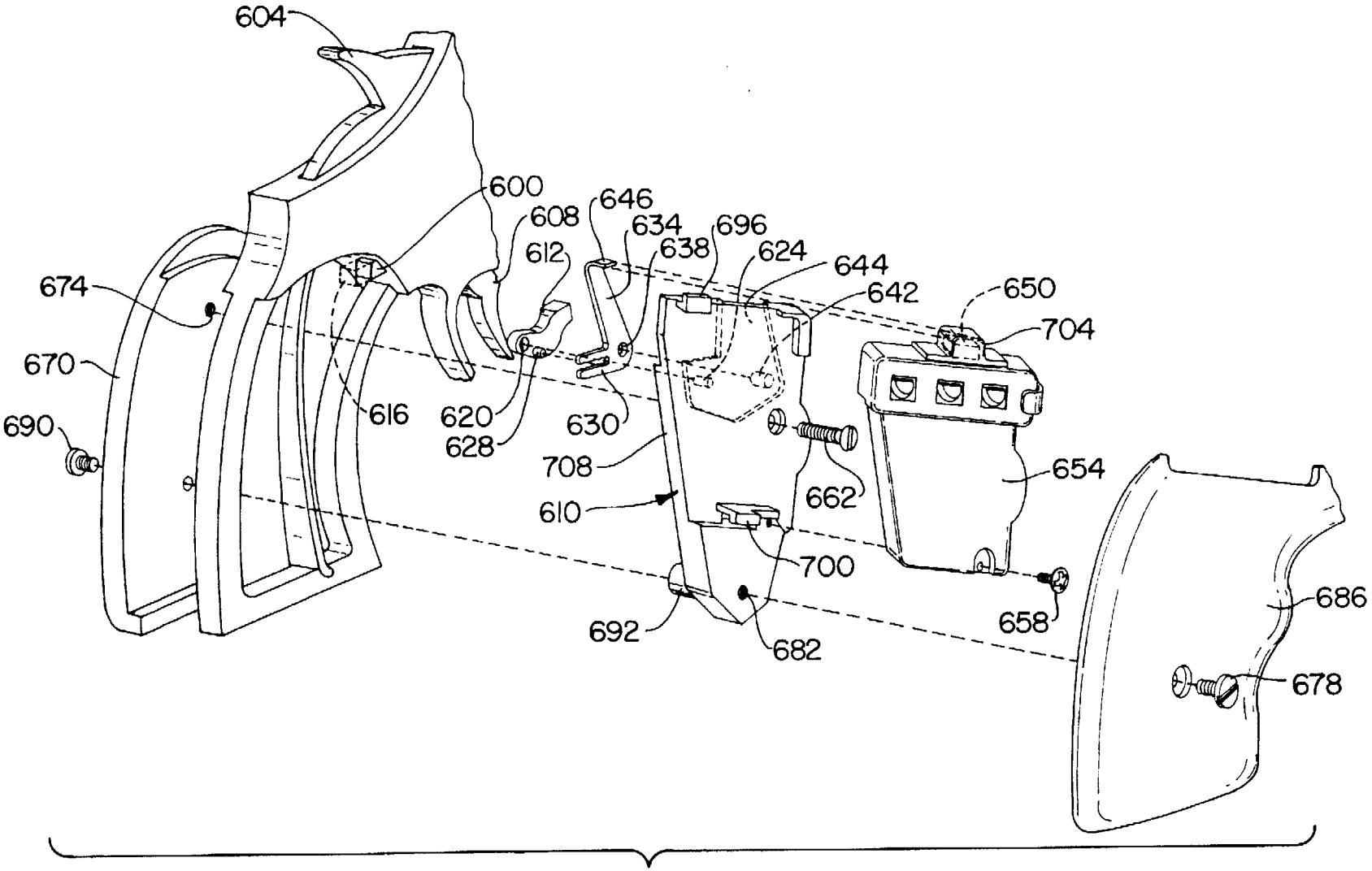
FIG. 14 is an exploded perspective, partially in phantom, of an embodiment of an adaptor plate for selectively blocking the rebound slide of a firearm.

An alternative embodiment of an adaptor plate that is used for blocking the rebound slide of a handgun is shown in FIG. 14. The rebound slide 600, as is known in the art, operates to draw the hammer 604 of the firearm backward upon squeezing of the trigger 608. Also, a slot is provided in the rebound slide 600 through which a corresponding protrusion (not shown) of the hammer 604 moves during the cocking operation. The movement of this protrusion in the slot of the rebound slide 600 guides the forward motion of the hammer during the firing operation. An adaptor plate 610 according to the invention is provided with structure for blocking movement of the rebound slide. The adaptor 610 has associated therewith a blocking member 612 which is moveable from a first position, blocking the rebound slide 600 and thereby preventing operation of the firearm, and a second position out of the way of the rebound slide 600, permitting movement of the rebound slide 600 to the position 616 and firing of the firearm.

The blocking member 612 is preferably pivotally mounted to the adaptor 610. An aperture 620 can be provided for mounting to a pin 624 on the adaptor plate 610. A pin 628 can be used to engage a slot 630 in a lever 634. An aperture 638 in the lever 634 can be pivotally mounted to a pin 642 on the adaptor 610. The lever 634 has an engagement flange 646 which is adapted to engage a suitable slotted opening 650 in a sliding member 704 of a lock 654 according to the invention. The lock 654 can be mounted to the adaptor 610 by a screw 658, and a screw 662 can be used to engage the adaptor 610 to the opposing grip 670 by engaging an aperture 674. A screw 678 can be utilized to engage an aperture 682 in the adaptor 610 to secure the grip 686 in position over the lock 654. Another screw 690 can engage an aperture provided in a protrusion 692 on the adaptor plate 610 to further secure the adaptor plate 610 and grips 670, 686 in place. A catch 696 can be provided for engaging the lock 654, and another catch 700 can be provided to engage the lock when in the locked position to prevent removal of the lock from the adaptor plate 610.

The lock 654 operates as previously described. The sliding member 704 moves with operation of the lock. The engagement member 646 of the lever 634 engages the slot 650 in the sliding member 704, such that movement of the sliding member 704 will operate to pivot the lever 634, which will pivot the slot 630 and the pin 628 to also pivot the blocking member 612. The blocking member 612 will be pivoted into and out of a blocking position with respect to the rebound slide 600 depending on the sliding position of the sliding member 704. In the locked position, the lever 634 is pivoted toward the front of the firearm and the blocking member 612 is raised to a position blocking the rebound slide 600. In an unlocked position, the sliding member 704 moves toward the back of the firearm and the blocking member 612 is pivoted out of the blocking position with respect to the rebound slide 600. A thickened portion 708 of the adaptor plate is provided to prevent the blocking member 612 from being pushed rearwardly by physical force. The pins 624 and 642 can be provided in a recessed portion 644 of the adaptor plate 610.

Figure 15:
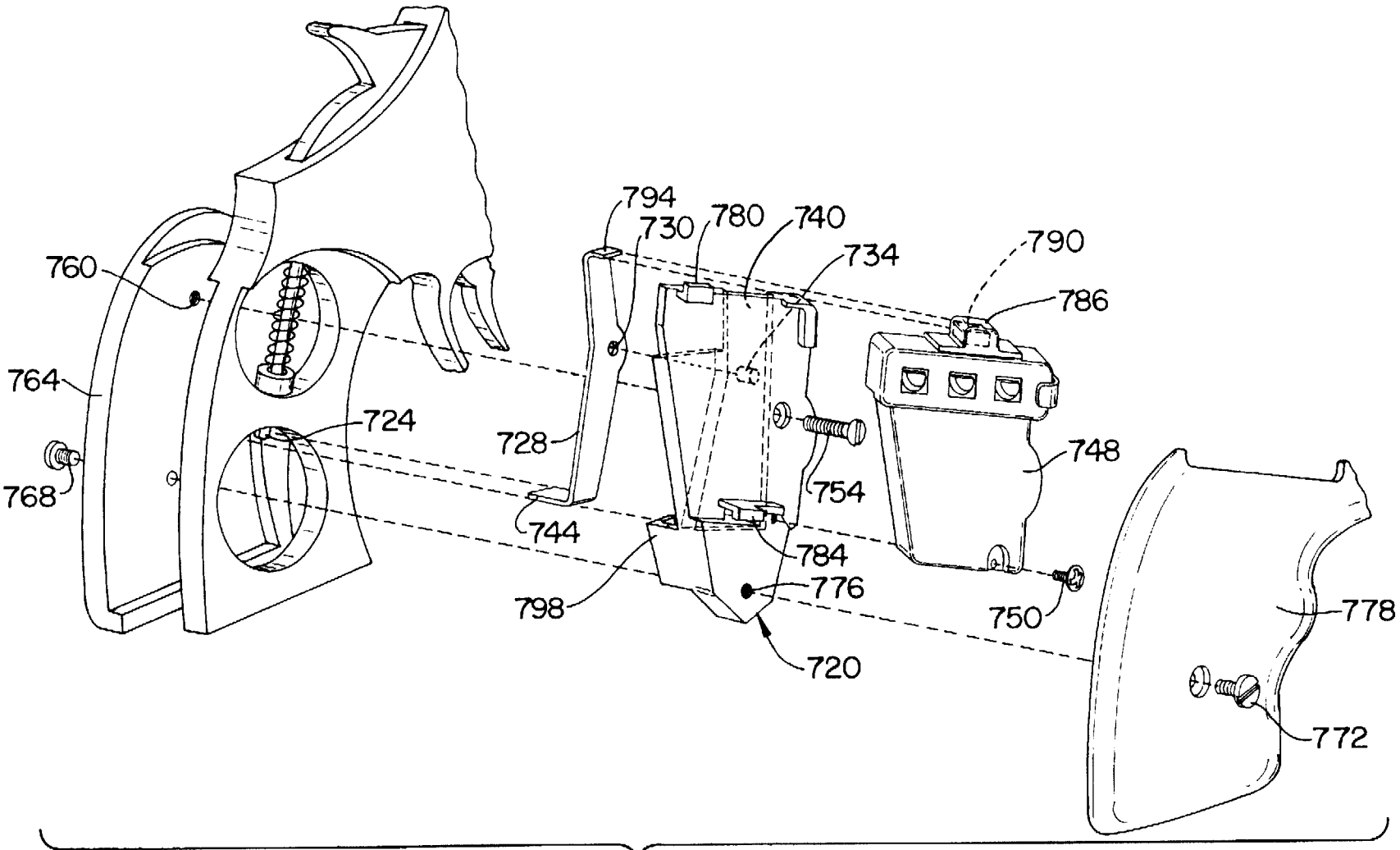
FIG. 15 is an exploded perspective, partially in phantom, of an adaptor plate assembly for blocking the hammer stirrup of a firearm.

Another embodiment of an adaptor plate according to the invention is shown in FIG. 15. The adaptor plate 720 includes structure for blocking the hammer stirrup 724 of the firearm. A blocking lever 728 has an aperture 730 by which the blocking lever 728 is mounted to a pin 734 in a recess 740 in an interior surface of the adaptor plate 720. An inwardly extending blocking portion 744 of the blocking lever 728 is adapted to move under the hammer stirrup 724 to prevent operation of the firearm, and alternatively to pivot out of the way of the hammer stirrup 724 to permit operation of the firearm.

A lock 748 is provided and can be engaged to the adaptor plate 720 by suitable means such as the screw 750. The adaptor plate 720 is secured to the firearm by suitable means such as the screw 754 which engages a suitable opening 760 in the opposing grip 764. A screw 768 can be utilized to engage the adaptor 720, and a screw 772 can be utilized to engage a suitable opening 776 in the adaptor 720 to secure the opposing grip 778 in position. As previously described, a catch 780 can be provided to engage the lock 748, and a second catch 784 can be utilized to engage the lock 748 when the lock is in the locked position to prevent removal of the lock 748 from the adaptor plate 720. The screw 754 will thereby be blocked against removal by an unauthorized user, as the lock 748 will be locked against removal from a position blocking access to the screw 754.

The sliding member 786 of the lock 748 includes an engagement slot 790 for engaging an engagement portion 794 of the blocking lever 728. Movement of the sliding member 786 will occur upon entering the appropriate combination. In a first position, the blocking lever 728 is pivoted such that the blocking portion 744 is out of the way of the hammer stirrup to permit operation of the firearm. In a second position, the sliding member 786 moves to locked position in which the blocking portion 744 is underneath the hammer stirrup 724 to prevent operation of the firearm. A thickened portion 798 of the adaptor plate 720 can be provided over which the blocking portion 744 is positioned when in the blocking position with respect to the hammer stirrup 724. The thickened portion 798 will help to support the blocking portion 744 in the event that an unauthorized user tries to force the blocking lever 728 out of position.

Figure 16:
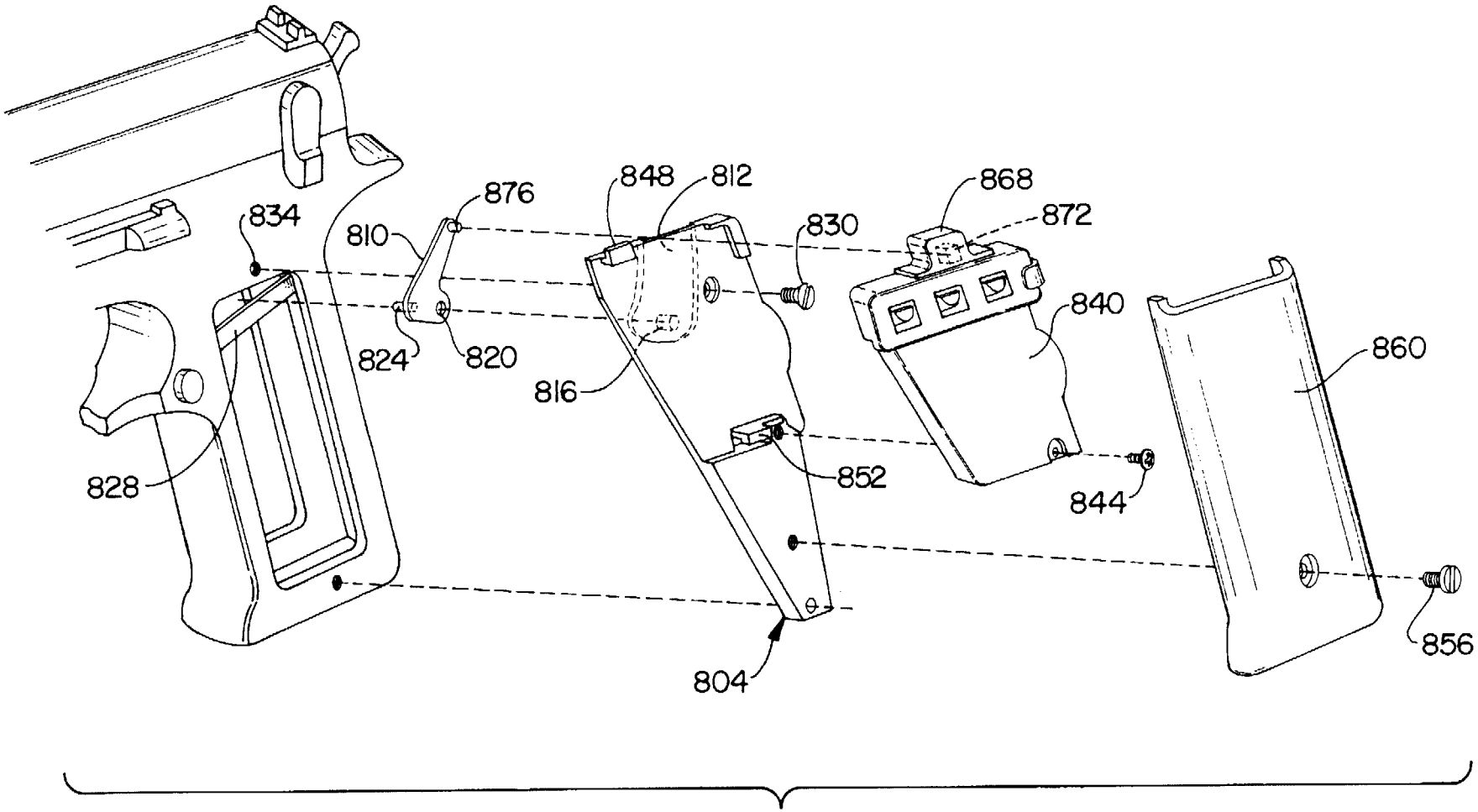
FIG. 16 is an exploded perspective, partially in phantom, of an adaptor plate for selectively moving the drawbar of the firearm to prevent operation of the firearm.

Another embodiment of an adaptor plate according to the invention is shown in FIG. 16. The adaptor plate 804 includes a lever 810 that can be mounted in a recessed interior surface 812 of the adaptor plate 804. A pin 816 can be provided on the adaptor plate 804 to engage a corresponding aperture 820 on the lever 810. An interiorly extending pin 824 is provided for engaging the draw bar 828 of the firearm. In one pivotal position the pin 824 is pivoted downwardly to move the drawbar 828 downward and to thereby render the firearm inoperable. Pivoting of the lever 810 in the opposite direction will raise the pin 824 to permit the drawbar 828 to rise and thereby to permit operation of the firearm. The adaptor plate 804 can be secured to the firearm by suitable structure such as the screw 830 which can engage an aperture 834 in the firearm. A lock 840 according to the invention is secured to the adaptor plate as by a screw 844. Catch structure 848 is utilized to engage the lock 840, and second catch structure 852 is provided to engage the lock 840 when the lock is in the locked position. A screw 856 can be utilized to secure the grip 860 in place over the lock 840. The lock 840 will conceal the screw 830 to prevent removal of the adaptor plate 804 by an unauthorized user.

The lock 840 has a sliding member 868 which has an engagement slot 872. A pin 876 on the lever 810 can engage the slot 872 such that, upon movement of the sliding member 868, the lever 810 is pivoted from the locking position in which the drawbar 828 is moved downwardly by the pin 824, and the unlocked position in which the drawbar 828 is permitted to rise by upward movement of the pin 824.

This invention can be provided in alternative embodiments which do not depart from the spirit or essential attributes thereof, and accordingly, reference should be had to the following claims, rather than to the foregoing specification, as indicating the scope of the invention.

I claim:

1. An adaptor for locking firearms having a firing mechanism and a handle frame, comprising:

fastening structure for engaging the firearm, said fastening structure comprising a plate dimensioned to the handle frame of the firearm;

engagement structure for engaging at least a portion of the firing mechanism and having a first position preventing operation of the firearm and having a second position permitting operation of the firearm.

2. The adaptor of claim 1, where said engagement structure comprises at least one pivoting lever.

3. The adaptor in claim 1, further comprising a lock operable in the locked position to prevent movement of said engagement structure to a position permitting operation of the firearm, and in an unlocked position, permitting movement of the engagement structure to a position permitting operation of the firearm.

4. The adaptor of claim 1, wherein the engagement structure comprises at least one lever pivotally mounted to said adaptor plate.

5. The adaptor of claim 4, further comprising a handle grip.

6. The adaptor of claim 3, further comprising interconnecting structure on said adaptor and on said lock such that, when the lock is in the locked position, the interconnecting structure is interconnected so as to prevent removal of the lock from the adaptor.

* * * * *